US007581642B2

(12) United States Patent
Knutson et al.

(10) Patent No.: US 7,581,642 B2
(45) Date of Patent: Sep. 1, 2009

(54) CHILD-RESISTANT, SENIOR-FRIENDLY UNIT DOSE CONTAINER

(75) Inventors: Curt Knutson, Loves Park, IL (US); Ryen Sack, Loves Park, IL (US); Ronald J. Seibert, Machesney Park, IL (US); Shawn P. Reilley, Belvidere, IL (US)

(73) Assignee: Anderson Packaging, Inc., Rockford, IL (US)

( * ) Notice: Subject to any disclaimer, the term of this patent is extended or adjusted under 35 U.S.C. 154(b) by 331 days.

(21) Appl. No.: 11/619,680

(22) Filed: Jan. 4, 2007

(65) Prior Publication Data

US 2007/0235368 A1 Oct. 11, 2007

Related U.S. Application Data

(60) Provisional application No. 60/757,429, filed on Jan. 9, 2006.

(51) Int. Cl.
*B65D 83/04* (2006.01)
*A45C 13/10* (2006.01)

(52) U.S. Cl. ..... 206/535; 206/1.5

(58) Field of Classification Search ..... 206/533, 206/535, 536, 537, 1.5, 528, 530, 531, 532, 206/538, 539

See application file for complete search history.

(56) References Cited

U.S. PATENT DOCUMENTS

| | | | | |
|---|---|---|---|---|
| 1,984,351 A | | 12/1934 | Johnson | |
| 2,790,587 A | * | 4/1957 | Contant | 206/232 |
| 3,072,276 A | | 1/1963 | Nichols | |
| 3,429,426 A | * | 2/1969 | Weller et al. | 206/531 |
| 3,504,788 A | | 4/1970 | Gray | |
| D217,900 S | * | 6/1970 | Gray | D9/732 |
| 3,811,564 A | | 5/1974 | Braber | |
| 3,888,350 A | | 6/1975 | Horvath | |
| 3,942,630 A | | 3/1976 | Phillips | |
| 4,048,050 A | * | 9/1977 | Hillman | 206/1.5 |

(Continued)

FOREIGN PATENT DOCUMENTS

DE 10355803 A1 6/2005

(Continued)

OTHER PUBLICATIONS esp@cenet database, one page English language Abstract for DE 10355803, Jun. 30, 2005.

(Continued)

*Primary Examiner*—J. Gregory Pickett
(74) *Attorney, Agent, or Firm*—Howson & Howson LLP

(57) ABSTRACT

A child-resistant and senior-friendly unit dose package has a hollow container body and a tray with a plurality of items secured thereto for being dispensed from the container body. The container body has an end with an elongate opening defined by a rim, and the tray can be slid to a retracted position in which the tray is located within the container body and a dispensing position in which the tray extends at least partially through the opening of the container body. The package includes a separate cap removably securable to the container body to seal the opening and prevent access to the tray. Multiple simultaneous manipulations are required to remove the cap from the container body thereby providing a child-resistant connection.

19 Claims, 10 Drawing Sheets

U.S. PATENT DOCUMENTS

| | | | | |
|---|---|---|---|---|
| 4,120,400 | A | 10/1978 | Kotyuk | |
| 4,125,190 | A | 11/1978 | Davie, Jr. et al. | |
| 4,126,224 | A | 11/1978 | Laauwe et al. | |
| 4,192,422 | A | 3/1980 | Kotyuk | |
| 4,375,858 | A | 3/1983 | Shah et al. | |
| 4,511,032 | A | 4/1985 | Bush | |
| 4,817,819 | A | 4/1989 | Kelly | |
| 4,889,238 | A * | 12/1989 | Batchelor | 206/535 |
| 5,050,739 | A | 9/1991 | Hannan et al. | |
| 5,082,137 | A | 1/1992 | Weinstein | |
| 5,265,728 | A | 11/1993 | Allendorf et al. | |
| 5,275,291 | A | 1/1994 | Sledge | |
| 5,339,960 | A | 8/1994 | Price | |
| 5,346,069 | A | 9/1994 | Intini | |
| 5,379,899 | A * | 1/1995 | Thurell | 206/538 |
| 5,740,938 | A | 4/1998 | Hofmann et al. | |
| 5,755,020 | A * | 5/1998 | Panyon, Jr. | 29/434 |
| 5,758,774 | A | 6/1998 | Leblong | |
| 5,871,145 | A | 2/1999 | Hermann et al. | |
| 5,878,887 | A | 3/1999 | Parker et al. | |
| 5,915,559 | A | 6/1999 | Hulick et al. | |
| 5,954,202 | A | 9/1999 | Mellon | |
| 6,021,901 | A | 2/2000 | Wolfe | |
| 6,036,018 | A | 3/2000 | Harrold | |
| 6,047,829 | A | 4/2000 | Johnstone et al. | |
| 6,161,699 | A | 12/2000 | Gartland | |
| 6,230,893 | B1 | 5/2001 | Karow | |
| 6,247,595 | B1 | 6/2001 | Omata et al. | |
| 6,273,260 | B1 | 8/2001 | ColDepietro et al. | |
| 6,349,831 | B1 | 2/2002 | Buss | |
| 6,394,275 | B1 | 5/2002 | Paliotta et al. | |
| 6,401,926 | B1 | 6/2002 | Lo | |
| 6,460,693 | B1 | 10/2002 | Harrold | |
| 6,540,081 | B2 | 4/2003 | Balz et al. | |
| 6,659,280 | B2 | 12/2003 | Paliotta et al. | |
| 6,679,381 | B1 | 1/2004 | Bush | |
| 6,708,826 | B1 | 3/2004 | Ginsberg et al. | |
| 6,789,677 | B2 | 9/2004 | Maietta | |
| 6,832,686 | B2 | 12/2004 | Donegan | |
| 6,863,175 | B2 | 3/2005 | Gelardi | |
| 6,874,636 | B2 | 4/2005 | Paliotta et al. | |
| 6,896,137 | B2 | 5/2005 | McHutchinson | |
| 6,913,149 | B2 | 7/2005 | Gelardi et al. | |
| 7,093,736 | B2 | 8/2006 | Maietta et al. | |
| 7,175,044 | B2 | 2/2007 | Benktzon et al. | |
| 7,347,325 | B2 | 3/2008 | O'Neill et al. | |
| 7,370,773 | B2 * | 5/2008 | Toth et al. | 220/348 |
| 2003/0080021 | A1 | 5/2003 | Kopecky | |
| 2003/0136698 | A1 | 7/2003 | Klatt | |
| 2004/0045858 | A1 | 3/2004 | Harrold | |
| 2004/0188312 | A1 | 9/2004 | Stepowany | |
| 2004/0256277 | A1 | 12/2004 | Gedanke | |
| 2005/0115862 | A1 | 6/2005 | Maietta | |
| 2005/0183981 | A1 | 8/2005 | Gelardi | |
| 2005/0199527 | A1 | 9/2005 | Ellis et al. | |
| 2006/0006091 | A1 | 1/2006 | Maietta | |
| 2007/0023317 | A1 | 2/2007 | Brozell et al. | |
| 2007/0039851 | A1 | 2/2007 | Rasanen et al. | |
| 2007/0045150 | A1 | 3/2007 | Huffer et al. | |
| 2007/0102318 | A1 | 5/2007 | Gelardi et al. | |
| 2007/0138049 | A1 | 6/2007 | Bitner | |
| 2009/0045096 | A1 * | 2/2009 | Knutson et al. | 206/570 |

FOREIGN PATENT DOCUMENTS

| | | | |
|---|---|---|---|
| EP | 1088769 | A1 | 4/2001 |
| GB | 2319244 | A | 5/1998 |
| WO | WO 02/06135 | A1 | 1/2002 |

OTHER PUBLICATIONS

Office Action dated May 11, 2009 received in co-pending commonly-owned U.S. Appl. No. 11/972,181.

* cited by examiner

FIG.9
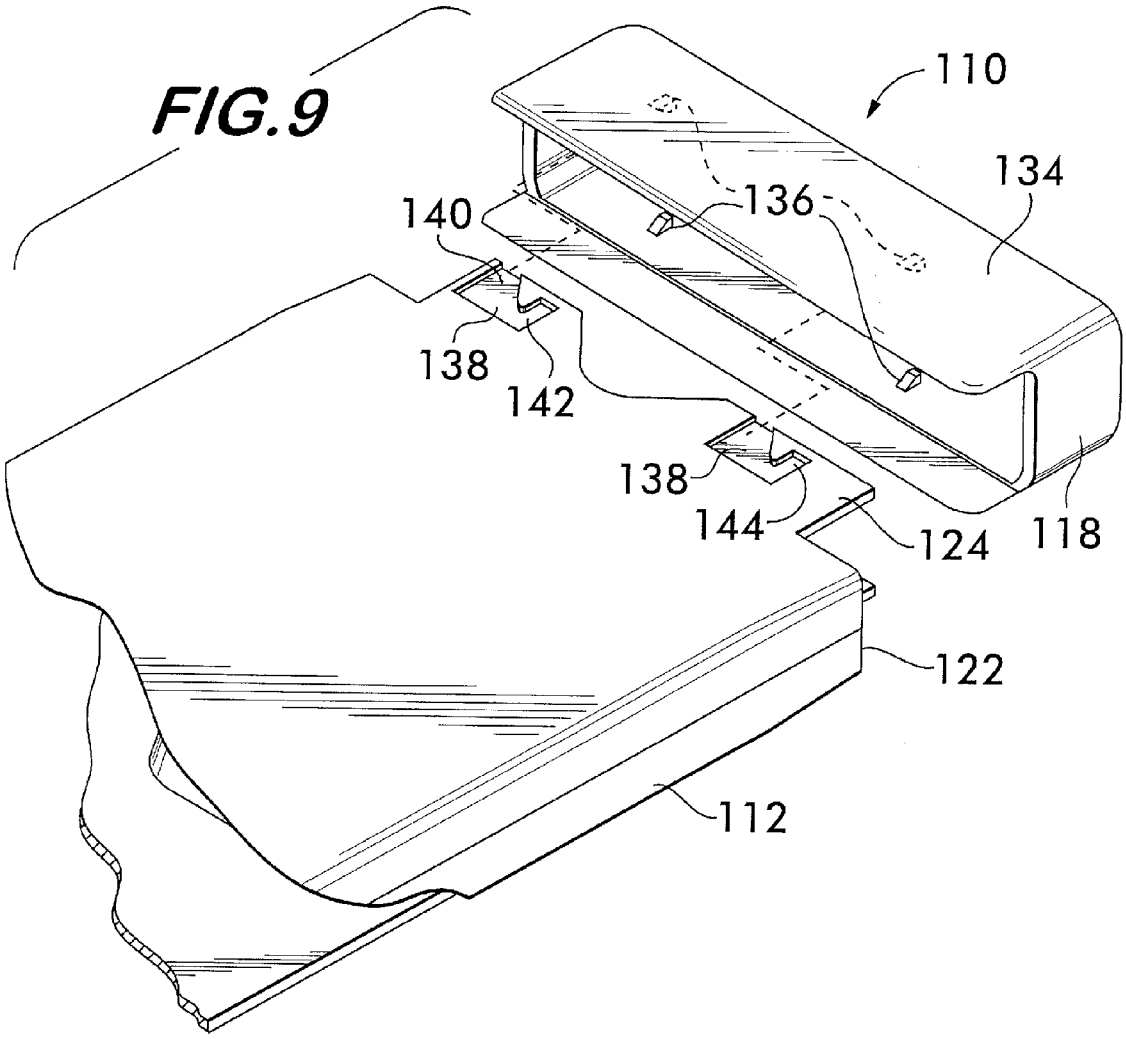
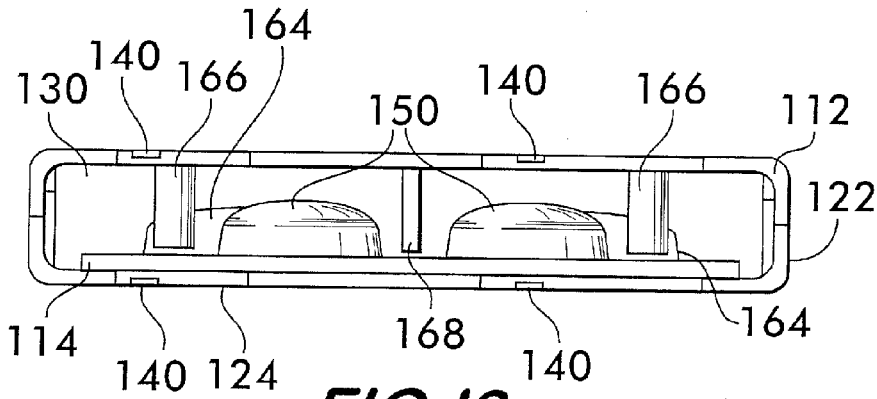
FIG.12

CHILD-RESISTANT, SENIOR-FRIENDLY UNIT DOSE CONTAINER

CROSS-REFERENCE TO RELATED APPLICATION

This application claims the benefit under 35 USC §119(e) of U.S. Provisional Patent Application No. 60/757,429, filed Jan. 9, 2006.

BACKGROUND OF THE INVENTION

The present invention relates to a container, or package, for containing items, such as doses of medicine, that can be dispensed therefrom, and more particularly, the present invention relates to a unit dose package that includes a blister or blister card and that has child-resistant, senior-friendly dispensing properties.

Paperboard unit dose packages for use in dispensing medicine tablets are disclosed by U.S. Pat. No. 6,047,829 issued to Johnstone et al., U.S. Pat. No. 6,874,636 B2 issued to Paliotta et al., and U.S. Pat. No. 6,230,893 B1 issued to Karow. Other containers for pills and the like are disclosed by U.S. patent application Publication Nos. 2005/0183981 A1 of Gelardi, 2005/0115862 A1 of Maietta, and 2005/0199527 A1 of Ellis et al., and by U.S. Pat. Nos. 4,192,422 and 4,120,400 issued to Kotyuk, U.S. Pat. No. 4,817,819 issued to Kelly, U.S. Pat. No. 6,349,831 B1 issued to Buss, U.S. Pat. No. 6,789,677 B2 issued to Maietta, U.S. Pat. No. 4,126,224 issued to Laauwe et al., U.S. Pat. No. 6,896,137 B2 issued to McHutchinson, U.S. Pat. No. 6,460,693 B1 issued to Harrold, U.S. Pat. No. 5,082,137 issued to Weinstein, U.S. Pat. No. 3,942,630 issued to Phillips, U.S. Pat. No. 5,878,887 issued to Parker et al., U.S. Pat. No. 6,401,926 B1 issued to Lo, U.S. Pat. Nos. 4,511,032 and 6,679,381 B1 issued to Bush, U.S. Pat. No. 6,021,901 issued to Wolfe, U.S. Pat. No. 6,832,686 B2 issued to Donegan, U.S. Pat. No. 5,346,069 issued to Intini, U.S. Pat. No. 6,913,149 B2 issued to Gelardi et al., U.S. Pat. No. 6,863,175 B2 issued to Gelardi, U.S. Pat. No. 6,540,081 B2 issued to Balz et al., U.S. Pat. No. 3,504,788 issued to Gray, U.S. Pat. No. 5,740,938 issued to Hofmann et al., and U.S. Pat. No. 4,048,050 issued to Hillman.

Although the above referenced unit dose packages and pill boxes disclosed by the above referenced patents and published applications may be satisfactory for their intended purposes, there is a need for a unit dose package of novel construction that is difficult for a child to open, yet readily opened and closed by an intended end-user, such as a senior citizen. Preferably, the container includes a blister, blister card, tray or the like on which numerous items, such as doses of medicine, are individually secured. The blister, blister card or tray should be able to be slid between a retracted position in which the items are protected and housed within the package and a dispensing position in which the blister, blister card or tray extends in an exposed condition from the package, but remains connected to the package.

BRIEF SUMMARY OF THE INVENTION

According to the present invention, a child-resistant and senior-friendly unit dose package has a hollow container body and a tray with a plurality of items secured thereto for being dispensed from the container body. The container body has an end with an elongate opening defined by a rim, and the tray is slidable between a retracted position in which the tray is located within the container body and a dispensing position in which the tray extends through the opening of the container body and is accessible by an end-user. The package includes a separate cap removably securable to the container body to seal the opening and prevent access of the items on the tray by young children and the like.

In a preferred embodiment, the container body and cap are made of plastic, and the engagement of lugs within slots enables the cap to be secured to the container body. Preferably, a spring, such as a leaf spring, urges the lugs into a captured position within the slots. Thus, removal of the cap from the container body requires hand pressure exerted simultaneously in both downward and lateral directions on the cap. Further, preferably the tray is a blister card and the elongate opening of the container body is substantially rectangular corresponding to the end profile of the blister card. A mechanism for preventing complete removal of the blister card from the container body is also provided.

BRIEF DESCRIPTION OF THE DRAWINGS

The present invention should become apparent from the following description when taken in conjunction with the accompanying drawings, in which:

FIG. 9 is a perspective view showing the cap removed from the container of FIG. 7;

FIG. 12 is an end view of the container and tray of FIG. 10 taken along line 12-12;

DETAILED DESCRIPTION OF THE INVENTION

Figure 1:
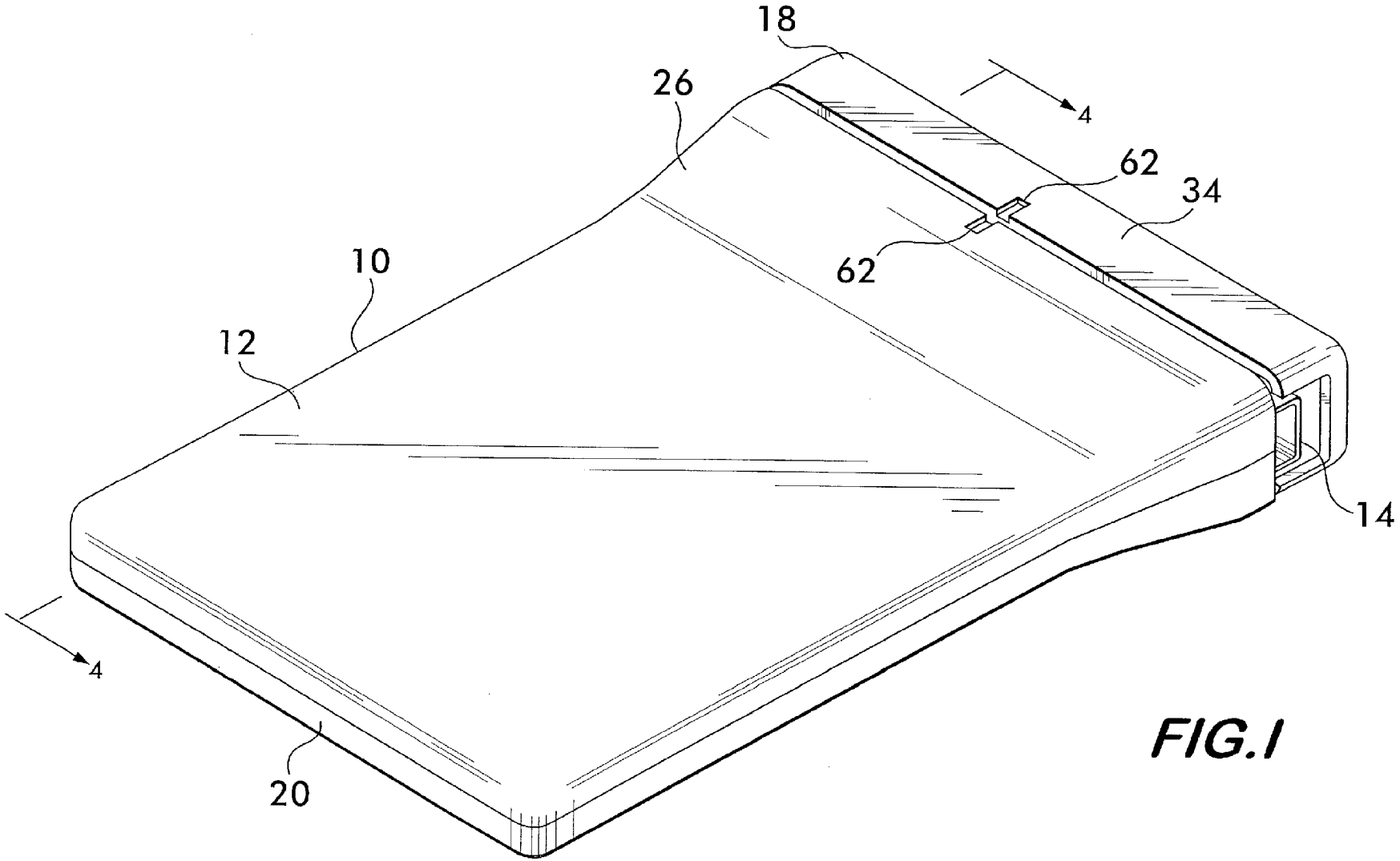
FIG. 1 is perspective view of a container and cap combination according to the present invention.
Figure 2:
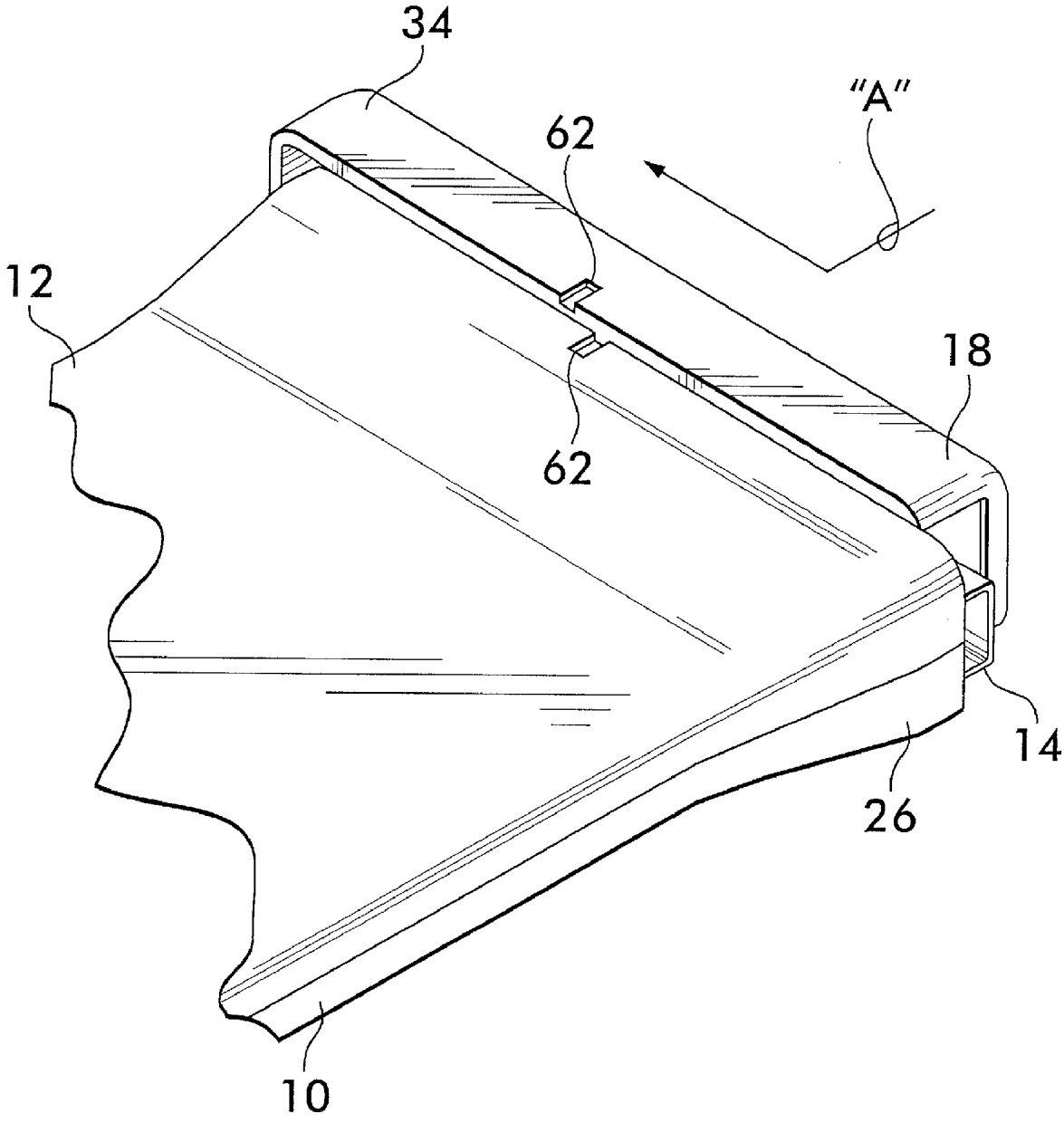
FIG. 2 is a perspective view showing the cap of FIG. 1 while being removed from the container of FIG. 1.

A first embodiment of a package 10 according to the present invention is illustrated in FIGS. 1-6 and includes a container body 12, a tray or card 14 to which a plurality of dispensable items 16 are secured, and a cap 18. The body 12 extends between closed and open ends, 20 and 22, and the cap 18 is securable to the body 12 to seal the open end 22 and removable from the body 12 to permit the tray 14 to be freely slid through the open end 22 into a dispensing position. The cap 18 can be repeatedly attached to and removed from the container 12 until all items 16 have been dispensed from the tray 14. By way of example, the tray 14 can be a blister card containing doses of medicine, and a child-resistant, senior-friendly connection can be formed between the container body 12 and cap 18.

Figure 4:
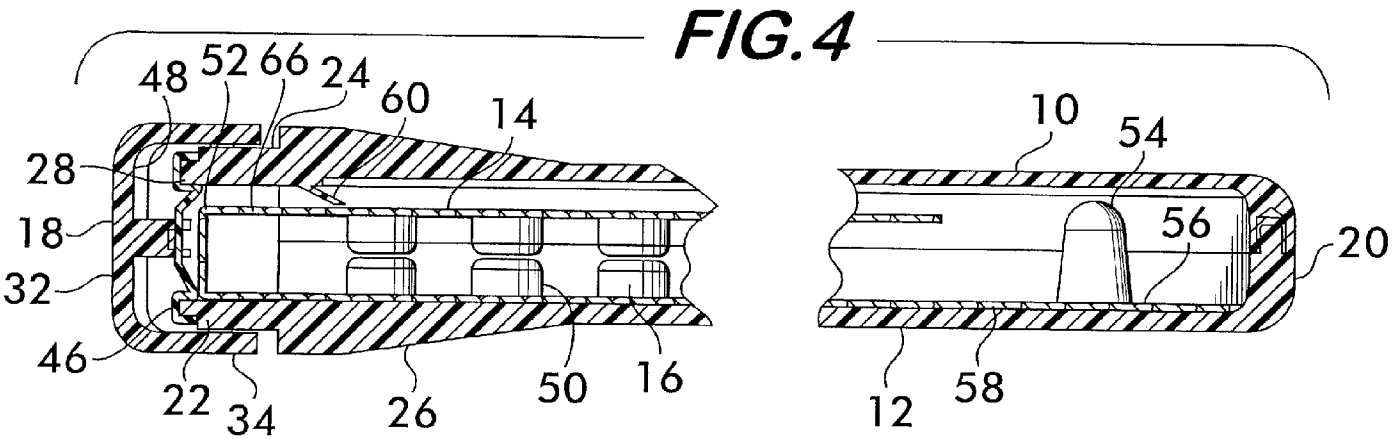
FIG. 4 is a cross-sectional view of the container, cap and blister card taken along line 4-4 of FIG. 1.
Figure 6:
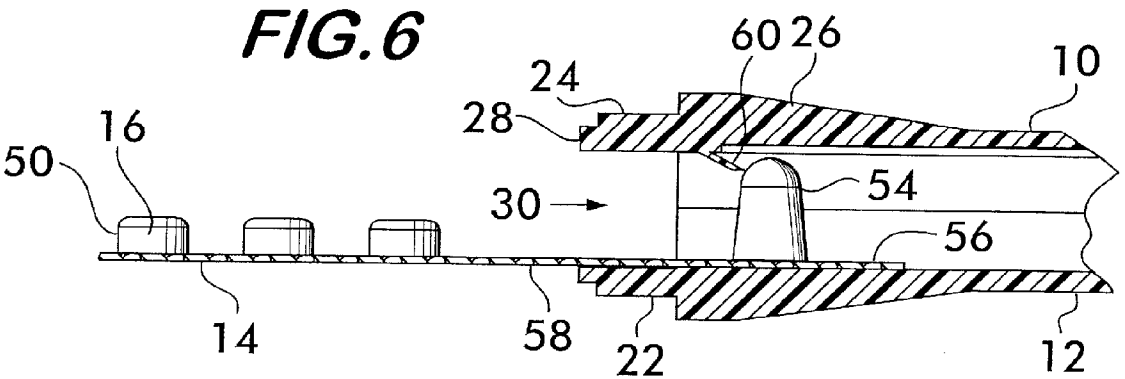
FIG. 6 is a cross-section view of the container similar to FIG. 4, except with the cap removed and the card extended therefrom.

The hollow container body 12 is preferably made of plastic and is shaped to house a blister card or the like. Thus, the body 12 can be generally flat and substantially rectangular, for instance, as illustrated in FIG. 1. The mouth, or finish, 24 of the container body 12 can form an outwardly tapered neck 26 as best illustrated in FIG. 4 and can include a rim 28 that defines a substantially rectangular, elongate opening 30 through which the blister card or the like can extend. The container body 12 can be formed as an integral molded piece or can be the assembly of two or more separately formed pieces. For example, the body 12, or components thereof, can be made by injection-molding, blow-molding, thermoforming, or like techniques.

The cap 18 is also preferably made of plastic via injection-molding, blow-molding, thermoforming, or like technique and includes an end wall 32 and peripheral sidewall 34 depending therefrom. The end wall 32 is substantially rectangular for covering the elongate opening 30 of the container body 12, and the sidewall 34 is of a size to closely fit about the finish 24 of the container body 12. Preferably, the cap 18 can be snapped onto the finish 24 and requires multiple simultaneously manipulations by the end-user to be removed from the container body 12. For example, the container body 12 and cap 18 can be designed so that removal is accomplished only by the simultaneous actions of depressing the cap 18 relative to the container body 12 and sliding the cap 18 laterally relative to the container body 12. See arrow "A" in FIG. 2.

Figure 3:
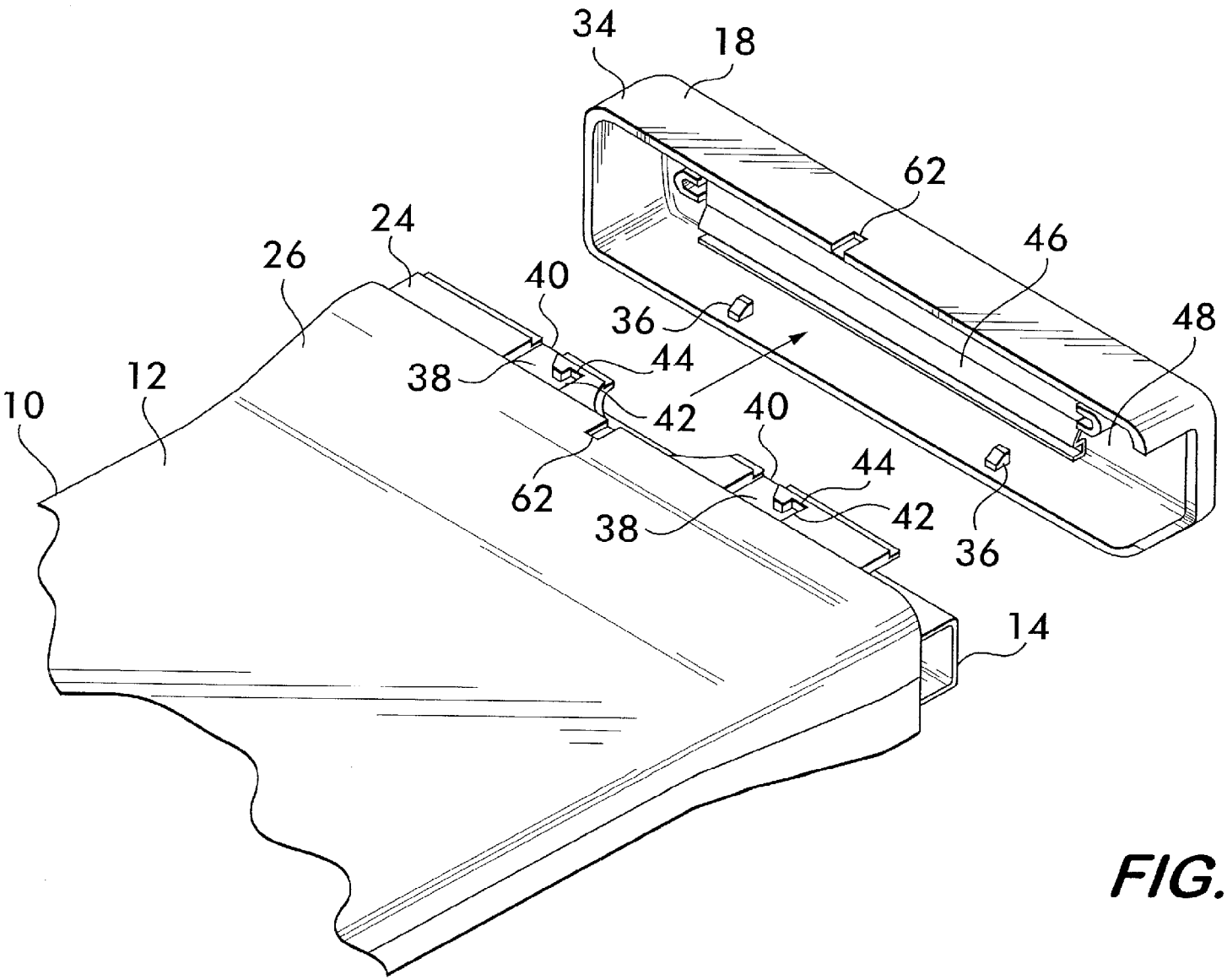
FIG. 3 is a perspective view showing the cap of FIG. 1 removed from the container of FIG. 1.

In the illustrated embodiment of the present invention, the mechanism for creating the child-resistant, senior-friendly cap-to-container body connection is provided by a series of cooperating lugs 36 and slots 38. The slots 38 provide pathways along which the lugs 36 are permitted to travel when the cap 18 is engaged to the container body 12. As best illustrated in FIG. 3, the lugs 36 extend inwardly from the sidewall 34 of the cap 18, and the slots 38 are formed in an external face of the finish 24 of the container body 12. Alternatively, the lugs can extend from the finish, and the slots can be formed in the cap.

Figure 5:
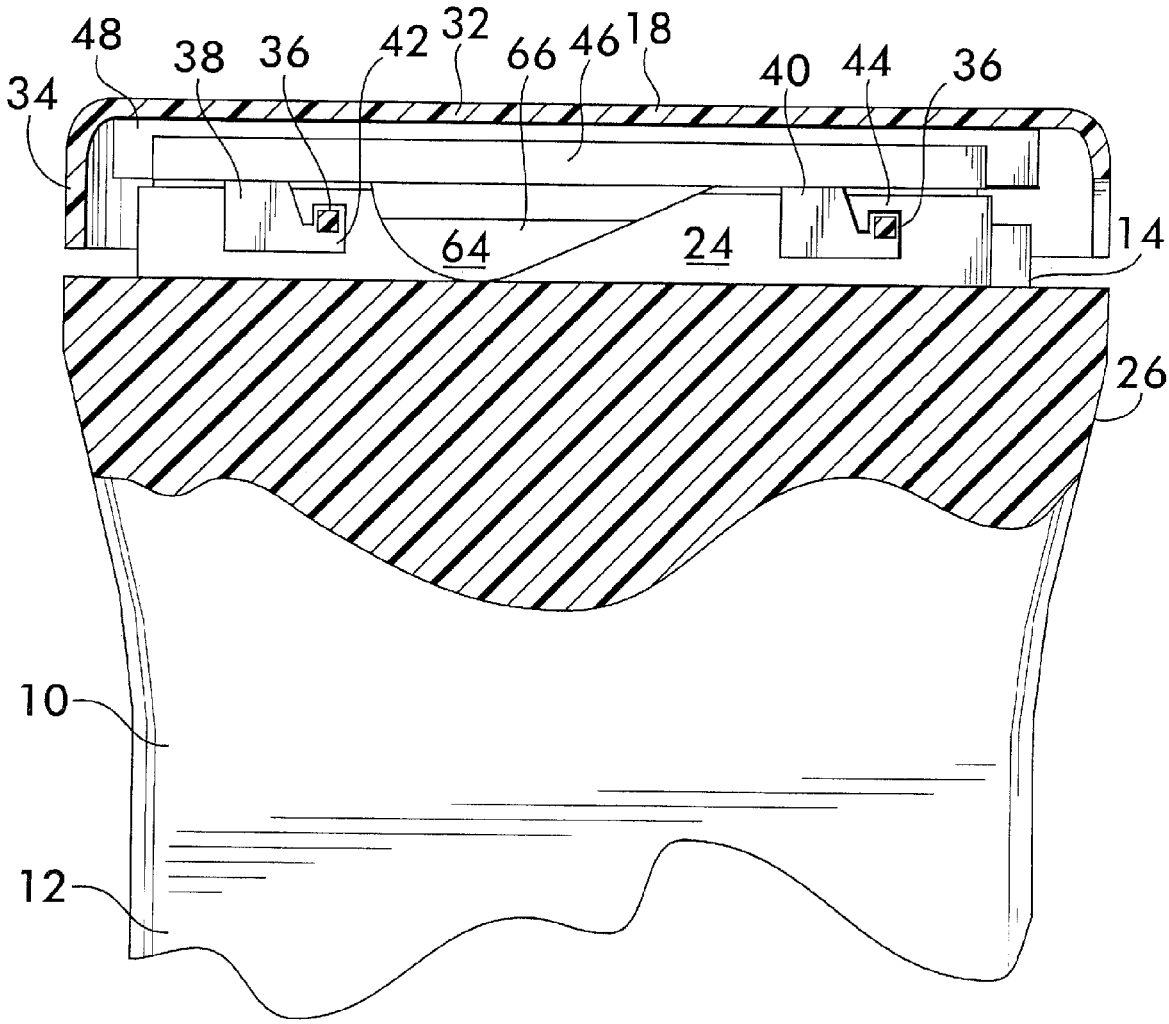
FIG. 5 is a cross-sectional view of the container and cap taken along a plane extending perpendicular to the end wall of the cap.
Figure 7:
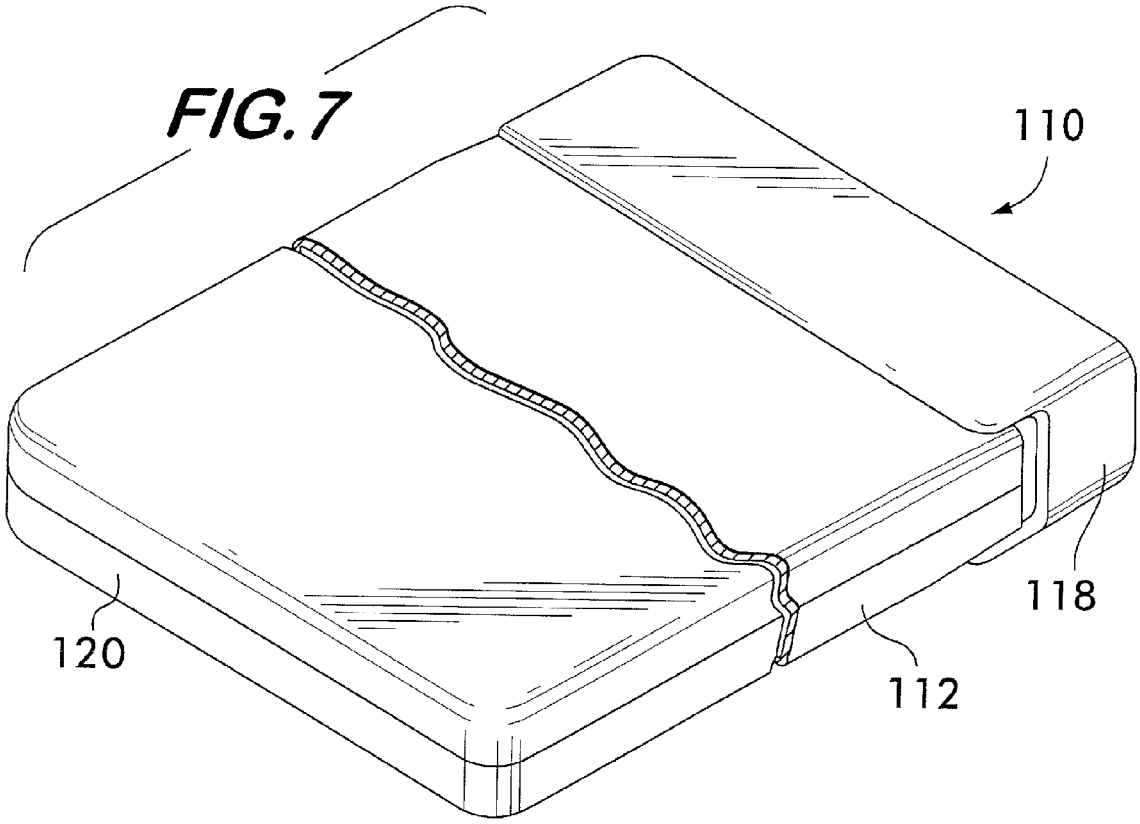
FIG. 7 is a perspective view of a second embodiment of a container and cap combination according to the present invention.
Figure 8:
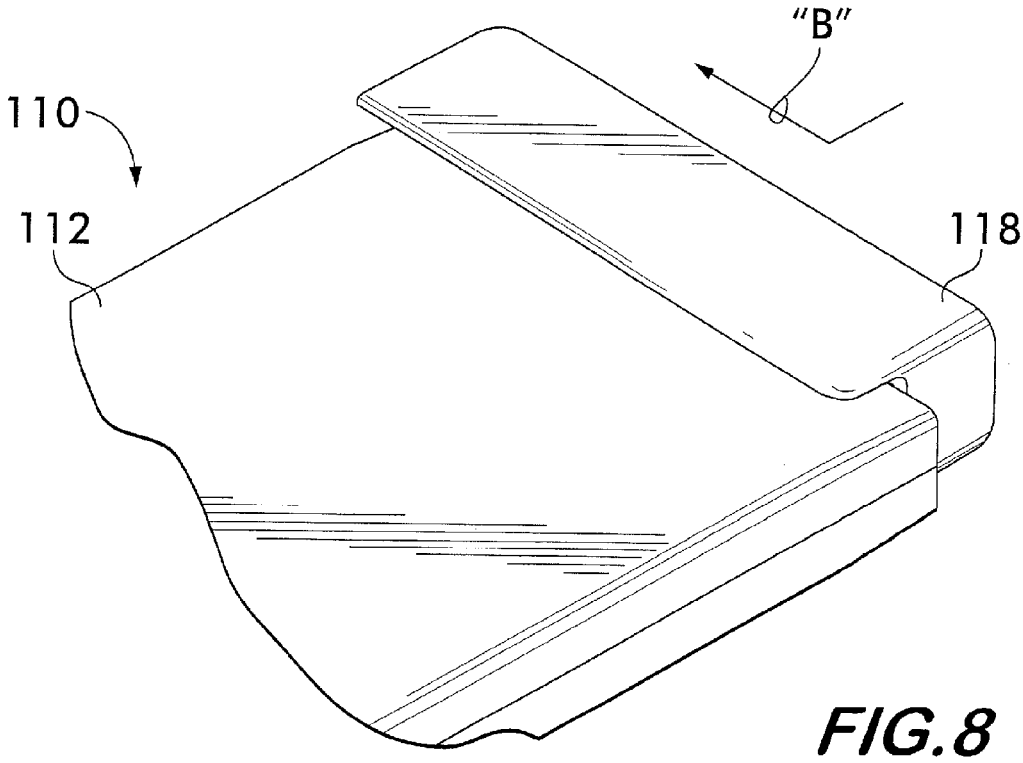
FIG. 8 is a perspective view showing the cap being removed from the container of FIG. 7.
Figure 10:
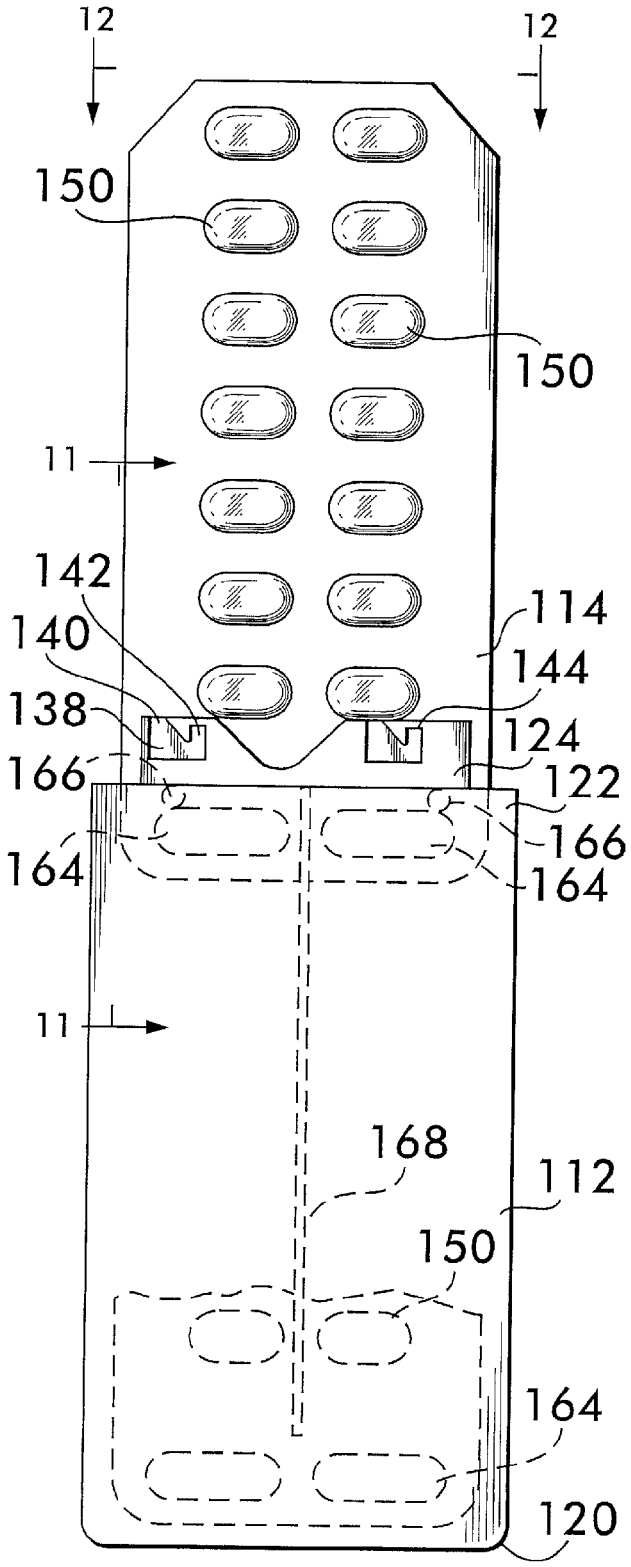
FIG. 10 is an elevational view showing the tray of the container of FIG. 7 in a dispensing position.
Figure 11:
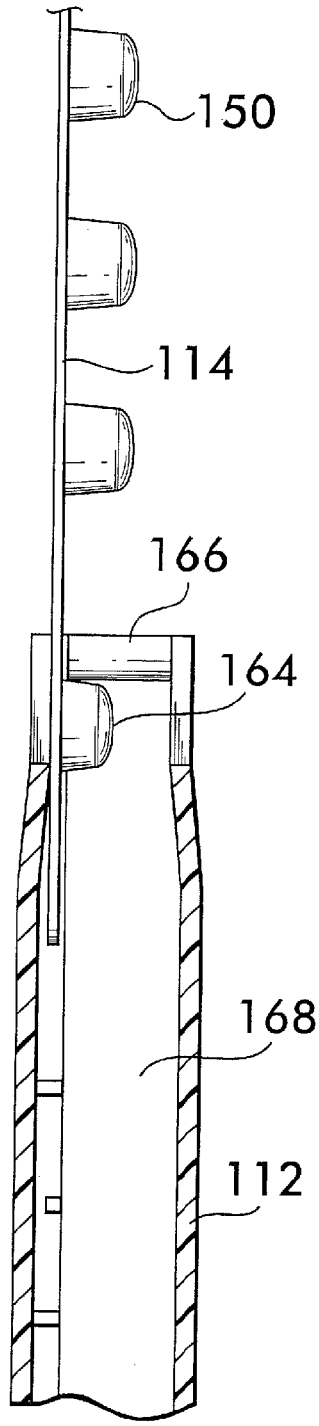
FIG. 11 is a cross-sectional view of the container and tray of FIG. 10 taken along line 11-11.
Figure 13:
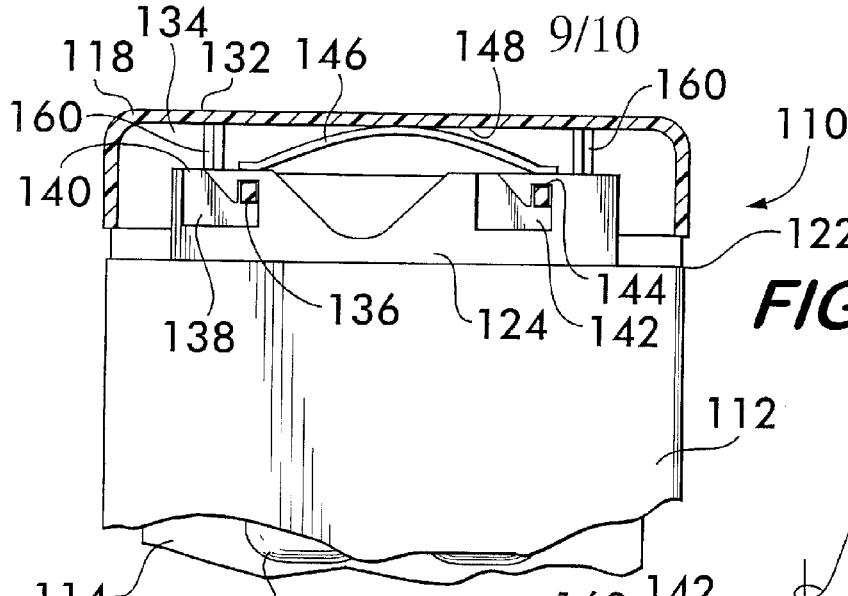
FIG. 13 is cross-sectional view of the cap in a condition secured to the container of FIG. 7.
Figure 14:
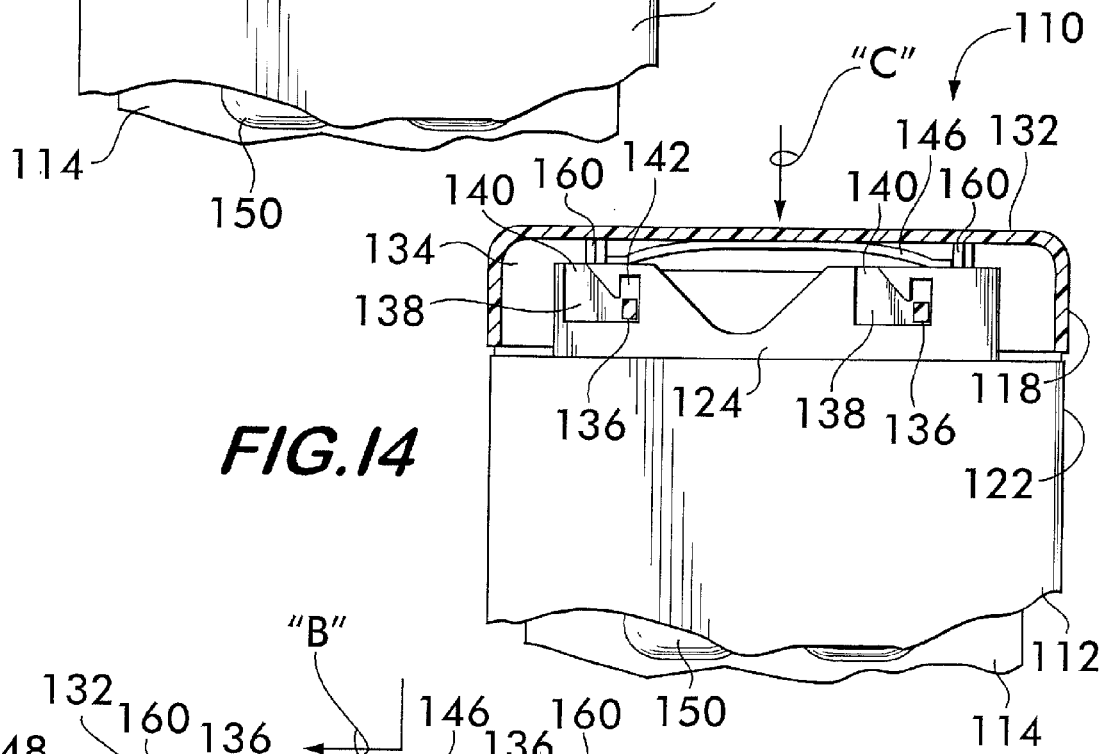
FIG. 14 is a cross-sectional view of the cap in a depressed condition relative to the container of FIG. 7.
Figure 15:
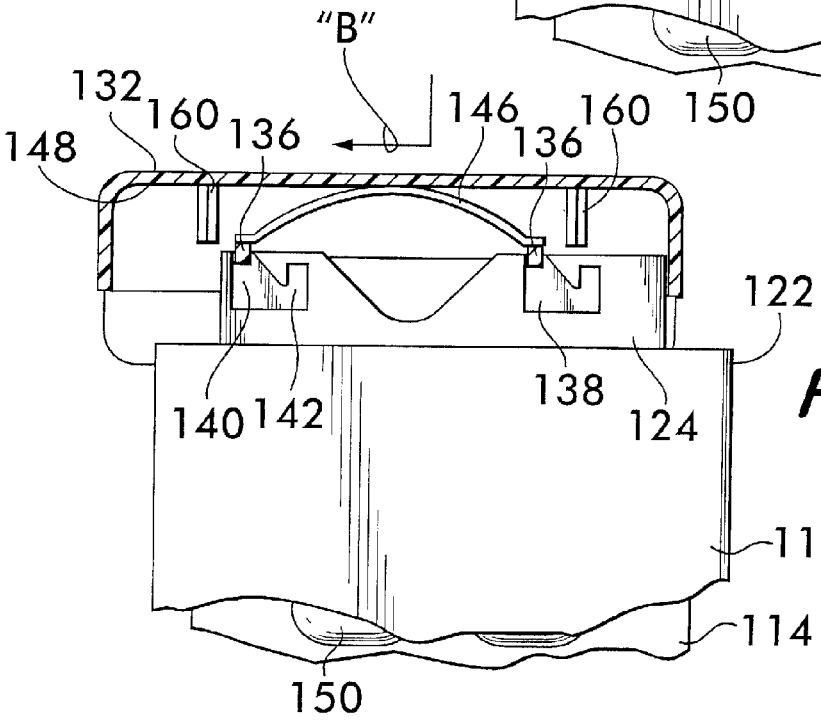
FIG. 15 is a cross sectional view of the cap being removed from the container of FIG. 7.
Figure 16:
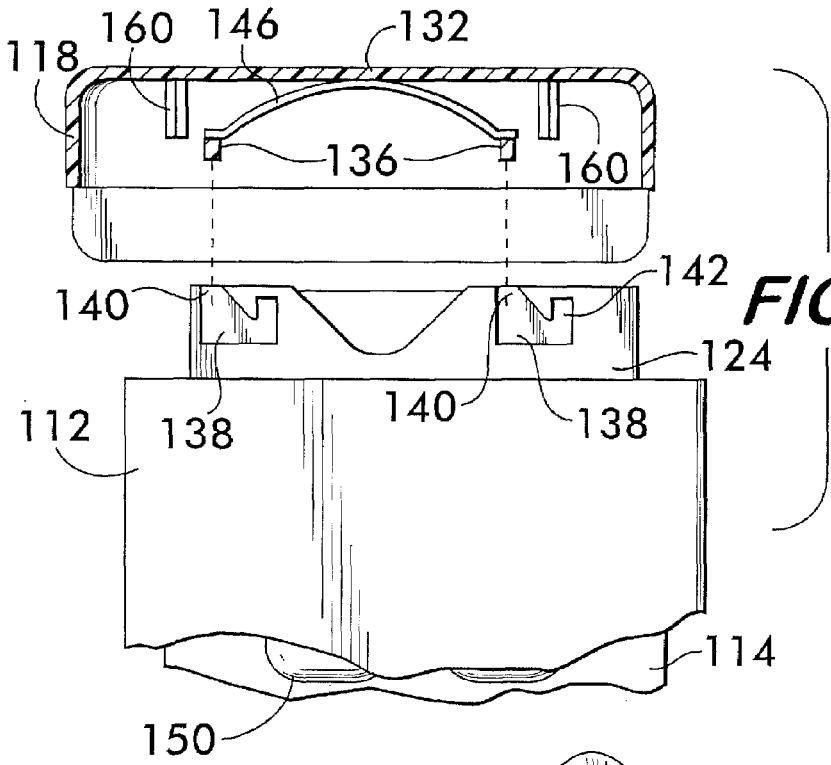
FIG. 16 is a cross sectional view of the cap removed from the container of FIG. 7.

In the illustrated embodiment, there are two slots 38 on each side of the elongate opening 30, and each slot 38 includes an open top 40 through which a lug 36 can pass and a reversely turned section 42 in which the lug 36 can be captured. Accordingly, the slots 38 have a substantially "J" or "U" shaped configuration as best illustrated in FIG. 5. The upper portion of each reversely turned section 42 includes perimeter walls 44 that prevent movement of the lug 36 both in an upward direction as well as in lateral directions. A spring or like mechanism 46 exerts a force on the cap 18 and container body 12 so that the cap 18 is resiliently biased away from the container body 12. Thus, when the lugs 36 are located within the reversely turned sections 42 of the slots 38, the spring 46 exerts a force between the cap 18 and container body 12 that prevents the lugs 36 from escaping the reversely turned sections 42. This locks the cap 18 to the container body 12 and prevents unwanted removal of the cap 18 by young children or the like.

Preferably, the spring 46 is a leaf spring or the like and is mounted on the underside 48 of the end wall 32 of the cap 18 so that, when the cap 18 is engaged to the container body 12, the spring 46 engages the rim 28 of the container body 12. Other types of springs can be used. An applied cap 18 can only be removed from the container body 12 by depressing the cap 18 against the force of the spring 46 and by simultaneously sliding the cap 18 laterally relative to the container body 12 so that the lugs 36 exit the reversely turned sections 42 of the slots 38 and escape the slots 38 through the top openings 40. These simultaneous manipulations are not readily accomplished by a young child, but can readily be accomplished by an adult.

After an item 16 is dispensed, the cap 18 can be readily re-applied to the finish 24 of the container body 12 by aligning the lugs 36 of the cap 18 with the open tops 40 of the slots 38. When the cap 18 is pressed onto the finish 24 of the container body 12, the lugs 36 are automatically directed and snap into the reversely turned sections 42 of the slots 38. Thereafter, the lugs 36 are retained in this captured position under the force of the spring 46.

The tray 14 is preferably a blister card or the like that carries items 16 in separate blister compartments 50 so that the items 16 can be removed one at a time from the card 14. The tray or blister card 14 can be made of plastic, paperboard, paper, foil or the like. In addition, as illustrated in FIG. 4, the tray 14 can include a fold or hinge 52 that permits the tray 14 to be folded upon itself before being inserted into the container body 12 through the elongate opening 30.

A tray locking mechanism is used to prevent complete removal of the tray or card 14 from the container body 12. For example, the tray 14 can be placed in a retracted position (see FIG. 4) in which the tray 14 is housed within the container body 12. The cap 18 can be applied to and/or removed from the container body 12 when the tray 14 is in the retracted position. After the cap 18 is removed from the container body 12, the tray 14 is free to slide through the elongate opening 30 to a dispensing position (see FIG. 6). Preferably, a locking flange 54 or the like extends from a face 56 of the tray 14 at a distal end 58 of the tray 14 and is prevented from passing beyond the elongate opening 30 of the container body 12 by an inturned flange 60 extending from an inner surface of the finish 24 of the container body 12. The blister card 14 can be unfolded to expose the blister compartments 50, while the distal end 58 of the blister card 14 remains captured or tethered to the container body 12. Other alternative tray locking mechanisms can be utilized.

In use, the plastic, relatively-rigid, substantially-rectangular package 10 can be used to store a blister card 14 carrying a predetermined amount of tablets, such as doses of prescribed or over-the-counter medicines, vitamins, supplements, or the like. Indicia, such as days, dates, or other information, can be displayed directly on the card to provide the end-user with reminders as to the rate at which the doses should be taken. Indicia can also be applied to the front and back of the container body and to the end wall of the cap. Further, the cap 18 and container body 12 can include alignment markings, such as grooves 62 that aid the user in properly aligning the cap 18 with the container body 12.

The end-user removes the cap 18 by pressing the cap 18 toward the container body 12 and simultaneously sliding the cap 18 in a lateral direction as can be indicated by arrows or like indicia on the cap 18. After the cap 18 is removed, the end-user can grip an exposed portion 64 of the blister card 14 adjacent the finish 24 of the container body 12 and slide the proximal end 66 of the blister card 14 out of the container body 12. Alternatively, the blister card 14 may be caused to slide out of the container body 12 via a quick hand flicking motion of the container body 12. When the distal end 58 of the blister card 14 reaches the elongate opening 30 of the container body 12, further movement of the blister card 14 is prevented. In this dispensing position, the card 14 extends from the mouth 24 of the container body 12 and may or may not require unfolding to permit the end-user to access the blister compartments 50. After one or more tablets 16 are removed from the blister card 14, the blister card 14 can be refolded and returned to within the container body 12 to a fully retracted storage position. Thereafter, the cap 18 can be reapplied and snapped into place on the container body 12. This process can be repeated until all blister compartments 50 are empty at which time the container body 12 and cap 18 can be reused, recycled, or discarded.

A second embodiment of a package 110 of the present invention is illustrated in FIGS. 7-17. The package 110 is similar in most respects to package 10 discussed above. For example, the package 110 includes a container body 112, a tray or blister card 114 to which a plurality of dispensable items are secured, and a cap 118. The body 112 extends between closed and open ends, 120 and 122, and the cap 118 is securable to the body 112 to seal the open end 122. The cap 118 is removable from the body 112 to permit the tray 114 to freely slide through the open end 122 into a dispensing position. See FIG. 10. The cap 118 can be repeatedly attached to and removed from the container 112 until all items have been dispensed from the tray 114.

The cap 118 is snapped onto the finish 124 of the container body 112 and requires multiple simultaneously manipulations by the end-user to be removed from the container body 112. The container body 112 and cap 118 are designed so that removal is accomplished only by the simultaneous actions of depressing the cap 118 relative to the container body 112 and sliding the cap 118 laterally relative to the container body 112. See arrow "B" in FIG. 8.

A child-resistant, senior-friendly cap-to-container body connection is provided by a series of cooperating lugs 136 and slots 138. The slots 138 provide pathways along which the lugs 136 are permitted to travel when the cap 118 is engaged to the container body 112. As best illustrated in FIG. 9, the lugs 136 extend inwardly from the sidewall 134 of the cap 118, and the slots 138 are formed in an external face of the finish 124 of the container body 112. Alternatively, the lugs can extend from the finish, and the slots can be formed in the cap.

There are two slots 138 on each side of the elongate opening 130 of the container body 112, and each slot 138 includes an open top 140 through which a lug 136 can pass and a reversely turned section 142 in which the lug 136 can be captured. Accordingly, the slots 138 have a substantially "J" or "U" shaped configuration as best illustrated in FIG. 9. The upper portion of each reversely turned section 142 includes perimeter walls 144 that prevent movement of the lug 136 both in an upward direction as well as in lateral directions. A spring or like mechanism 146 exerts a force on the cap 118 and container body 112 so that the cap 118 is resiliently biased away from the container body 112. Thus, when the lugs 136 are located within the reversely turned sections 142 of the slots 138, the spring 146 exerts a force between the cap 118 and container body 112 that prevents the lugs 136 from escaping the reversely turned sections 142. See FIG. 13. This locks the cap 118 to the container body 112 and prevents unwanted removal of the cap 118 by young children or the like.

The spring 146 of the package 110 has an H-shaped configuration and is curved, or bowed, along its length. See FIG. 17. The spring 146 is mounted on the underside 148 of the end wall 132 of the cap 118 and is captured thereto by the lugs 136 and abutments 160 of the cap 118. When the cap 118 is secured to the container body 112, the spring 146 applies a force to lock the lugs 136 within the slots 138. See FIG. 13. When pressure is exerted on the cap 118 as shown by arrow "C" in FIG. 14, the spring 146 flattens thereby permitting the lugs 136 to exit the slots 138. Upon removal of the cap 118 from the container body 112, the spring 146 automatically and resiliently returns to its original and memorized bowed configuration. See FIGS. 15 and 16.

Figure 17:
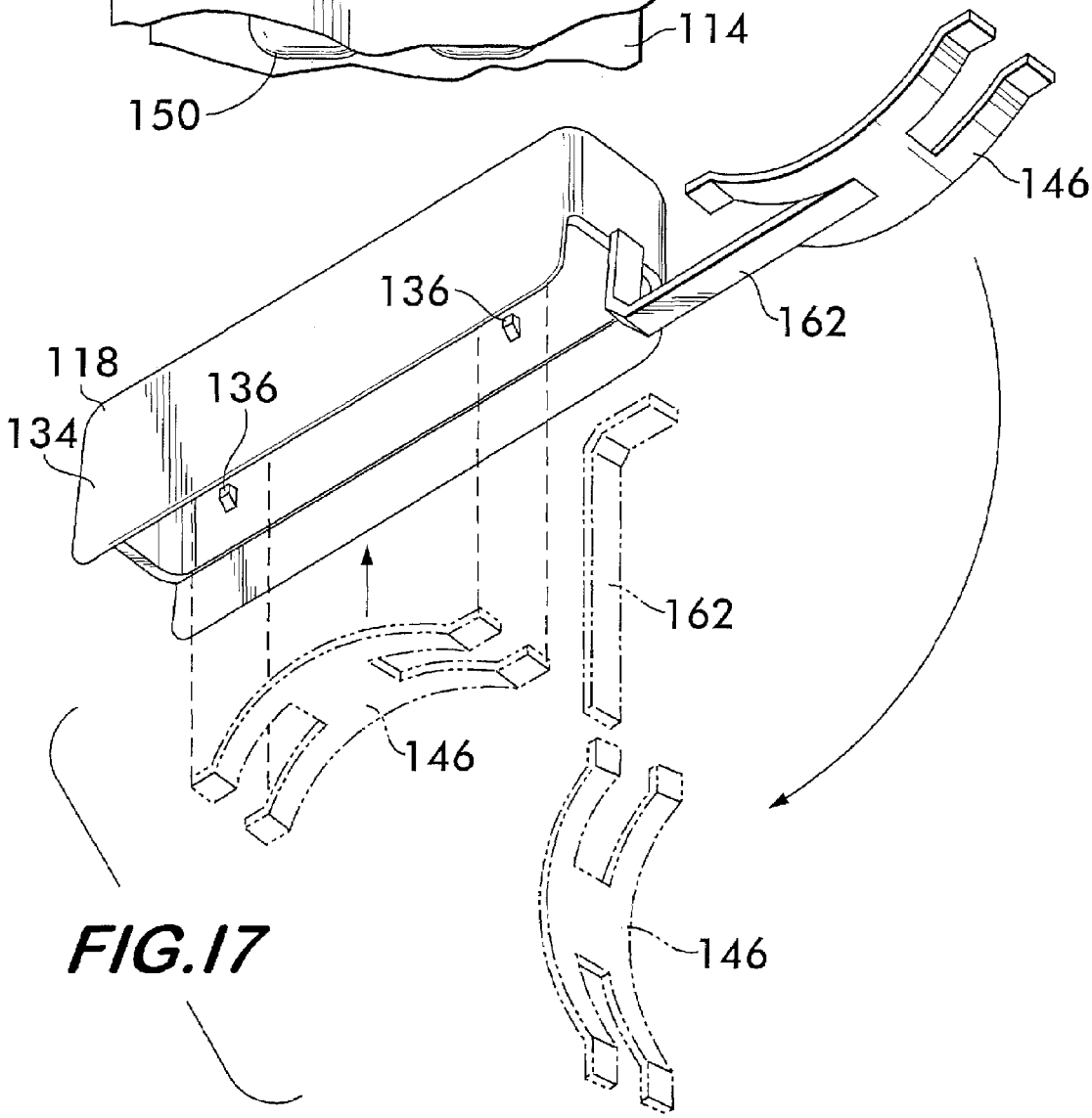
FIG. 17 is a perspective view of the assembly of the cap of FIG. 7.

A cap assembly is illustrated in FIG. 17. In this embodiment, the cap 118 is simultaneously molded with the spring 146 in the same mold and of the same material. Upon removal of the cap assembly from the mold, the cap 118 is connected to the spring 146 via an arm 162. The arm and spring 146 can be pivoted as shown by arrow "D" in FIG. 17 to locate the spring 146 and arm 162 within the cap 118. Alternatively, the arm can be broken away from the cap 118 and spring 146, as shown in phantom in FIG. 17, and discarded. Thereafter, the spring 146 is inserted into the cap 118 beyond the lugs 136.

The tray 114 is preferably a blister card that carries items in separate blister compartments 150 and that includes one or more end blister compartments 164. See FIGS. 10 and 11. The compartments 164 extend laterally to a greater extent on the card 114 relative to compartments 150. Accordingly, the compartments 150 fit between a pair of posts 166 extending within the container body 112 and permit the card 114 to be positioned to the dispensing position shown in FIG. 10. However, the compartments 164 do not fit between the posts 166, thereby capturing the card 114 to the container body 112.

In addition to the posts 166, the container body 112 also includes a spine 168 extending centrally within the container body 112 between the blister compartments 150. The spine 168 and posts 166 rigidify the container body 112 and prevent unintended compression of the container body 112. However, since the posts 166 and spine 168 extend from only one side of the container body 112, the card 114 is permitted to slide relative to the posts 166 and spine 168 within the container body 112 between the retracted position and the dispensing position.

While preferred unit dose packages have been described in detail, various modifications, alterations, and changes may be made without departing from the spirit and scope of the unit dose package according to the present invention as defined in the appended claims.

The invention claimed is:

1. A unit dose package, comprising:

a hollow plastic container body having an end with an elongate opening defined by a rim;

a blister card having a plurality of separate blister compartments with a plurality of items separately secured therein for being dispensed from said container body, said elongate opening of said container body corresponding in size to an end profile of said blister card so that said blister card is slidable only in an end-to-end direction relative to said container body through said elongate opening between a retracted position in which said blister card is located within said container body and a dispensing position in which a part of said blister card extends through said opening of said container body;

a plastic cap removably securable to said container body to seal said opening and prevent access to said blister card, said cap having an end wall with a spring captured to an underside thereof; and a locking mechanism for preventing a distal end of said blister card from passing through said elongate opening of said container body.

2. A package according to claim 1, wherein one of said container body and cap has a series of lugs and the other has a series of slots along which said lugs can travel when said cap is engaged to said container body.

3. A package according to claim 2, wherein said spring is retained in a position within said cap to apply a resilient force to cause said lugs to be retained in a captured position within said slots thereby preventing unwanted removal of said cap from said container body.

4. A package according to claim 3, wherein said cap has a peripheral sidewall extending from said underside of said end wall, wherein said lugs extend inwardly from said sidewall of said cap and capture said spring against said underside, and wherein said spring engages said rim of said container body when said cap is engaged therewith.

5. A package according to claim 4, wherein each of said slots is formed in an outer surface of a finish of said container body and has a reversely turned section and an open section, whereby removing said cap from said container body requires said cap to be pressed toward said container body against the force of said spring and slid laterally so that said lugs are permitted to exit said reversely turned sections and extend through said open sections.

6. A package according to claim 1, wherein said items are doses of medicines.

7. A package according to claim 1, wherein said elongate opening of said container body and said end wall of said cap are substantially rectangular.

8. A package according to claim 1, wherein said cap is formed of one-piece construction and is integral with said spring, and wherein an arm that pivots interconnects said cap to said spring.

9. A package according to claim 8, wherein said spring is an H-shaped leaf spring and is continuously bowed along its length.

10. A package according to claim 1, wherein said blister card includes a flat card portion having an upper face and a rear face, wherein said blister compartments project from said upper face, wherein said container body includes a spine extending within said hollow container body from a wall of said container body, and wherein said spine engages said upper face and forces said flat card portion against an opposite wall of said container body yet permits said blister card to slide relative to said container body.

11. A package according to claim 10, wherein said locking mechanism includes an end blister compartment on said distal end of said blister card and a post extending within said container body adjacent said elongate opening that prevents passage of said end blister compartment through said opening.

12. A container for doses of medicine, comprising:

a hollow plastic container body having an open end with an elongate, substantially-rectangular rim and an opposite closed end, said container body being substantially rectangular in transverse cross-section;

a substantially flat blister card carrying a plurality of doses of medicine within separate blister compartments projecting from an upper face of said blister card, said open end of said container body corresponding in size to an end profile of said blister card so that said blister card is slidable in only an end-to-end direction relative to said container body such that said blister card is positionable in a retracted position in which said blister card is located within said container body and a dispensing position in which said blister card extends at least partly through said open end of said container body;

a plastic cap removably securable to said rim of said container body to seal said open end of said container body, said cap has a substantially-rectangular end wall and a peripheral sidewall extending from an underside of said end wall;

a spring mounted on said underside of said end wall of said cap in a position to engage said rim of said container body when said cap is applied to said open end of said container body; and a locking mechanism preventing said blister card from undesired separation from said container body.

13. A package according to claim 12, wherein lugs extend inwardly from said sidewall of said cap and project within slots formed on an outer surface of said container body adjacent said rim when said cap is applied to said open end of said container body, and wherein said lugs capture said spring within said cap when said cap is removed from said container body.

14. A package according to claim 13, wherein said spring applies a resilient force to cause said lugs to be retained in a captured position within reversely turned sections of said slots when said cap is applied to said container body thereby preventing unwanted removal of said cap from said container body.

15. A package according to claim 14, wherein said slots have a substantially J-shaped or U-shaped configuration, whereby removing said cap from said container body requires said cap to be simultaneously pressed toward said container body against the force of said spring and slid laterally so that said lugs exit said slots through an opening at a top of the slot.

16. A package according to claim 14, wherein said cap is integral with said spring, is made of the same material as said spring, and is interconnected to said spring via an arm that pivots relative to said cap.

17. A package according to claim 14, wherein said spring is an H-shaped leaf spring and is continuously bowed along its length.

18. A package according to claim 14, wherein said container body includes a spine extending within said hollow container body from a wall of said container body, said spine engages said upper face of said blister card and urges said blister card against an opposite wall of said container body yet permits said blister card to slide relative to said container body.

19. A package according to claim 14, wherein said locking mechanism includes an end blister compartment on a distal end of said blister card and a post extending within said container body adjacent said open end of said container body that prevents passage of said end blister compartment through said open end.

* * * * *